United States Patent [19]

Moldenius

[11] Patent Number: 4,734,160

[45] Date of Patent: Mar. 29, 1988

[54] METHOD OF TWO-STAGE PEROXIDE BLEACHING OF MECHANICAL OR SEMI-MECHANICAL PULP

[75] Inventor: Steve Moldenius, Taby, Sweden

[73] Assignee: Sunds Defibrator AB, Sundsvall, Sweden

[21] Appl. No.: 818,064

[22] PCT Filed: Dec. 16, 1983

[86] PCT No.: PCT/SE83/00462

§ 371 Date: Aug. 17, 1984

§ 102(e) Date: Aug. 17, 1984

[87] PCT Pub. No.: WO84/02366

PCT Pub. Date: Jun. 21, 1984

Related U.S. Application Data

[63] Continuation of Ser. No. 639,140, Aug. 17, 1984, abandoned.

[30] Foreign Application Priority Data

Dec. 17, 1982 [SE] Sweden ..... 8207236

[51] Int. Cl.[4] ..... D21C 9/16

[52] U.S. Cl. ..... 162/71; 162/78

[58] Field of Search ..... 162/78, 19, 71, 56, 162/57

[56] References Cited

U.S. PATENT DOCUMENTS

| | | | |
|---|---|---|---|
| 3,966,542 | 6/1976 | Oldshue | 162/57 |
| 4,294,653 | 10/1981 | Lindahl et al. | 162/78 |
| 4,450,044 | 5/1984 | Fritzvold et al. | 162/78 |

FOREIGN PATENT DOCUMENTS

| | | | |
|---|---|---|---|
| 2601380 | 7/1976 | Fed. Rep. of Germany | 162/78 |

OTHER PUBLICATIONS

Singh, "The Bleaching of Pulp", TAPPI Press, Atlanta, Ga. 1979.

*Primary Examiner*—Steve Alvo

*Attorney, Agent, or Firm*—Oblon, Fisher, Spivak, McClelland & Maier

[57] ABSTRACT

A method of peroxide bleaching lignocellulose-containing material for providing a pulp of both high strength and brightness. Increase in strength is provided in a first stage by hyper-alkaline peroxide bleaching known per se, i.e. bleaching carried out at an initial pH of over 12, measured in the bleaching liquid at 24° C. before mixing into the pulp. The desired brightness increase is provided in a subsequent stage with or without intermediate washing of the pulp and at a lower initial pH.

7 Claims, No Drawings

METHOD OF TWO-STAGE PEROXIDE BLEACHING OF MECHANICAL OR SEMI-MECHANICAL PULP

This application is a continuation of application Ser. No. 639,140, filed Aug. 17, 1984, now abandoned.

DESCRIPTION

The present invention relates to peroxide bleaching of lignocellulose-containing material, particularly mechanical and mechano-chemical pulp. Peroxide bleaching is normally carried out solely in one step and for increasing the brightness of the pulp. (In certain cases, e.g. for fluff, the intention may also be to improve the water absorption ability). It is known that the pulp properties are then altered a little, the density, smoothness and strength increase. It has also been found that strength and smoothness can be increased considerably in peroxide bleaching with high initial pH: tensile index by 50% and Scott Bond by 150%. The disadvantage in bleaching with an initial pH level above the one which is optimum for brightness, i.e. so-called hyper-alkaline peroxide bleaching (HAPB) is that brightness becomes relatively low in relation to the peroxide charge.

The present invention relates to producing a pulp by peroxide bleaching, which is both strong and bright. This result is obtained in accordance with the invention, in principle by bleaching being carried out in two stages at different pH values. In the first stage, which may be denoted HAPB, bleaching is carried out at a high pH (over 12), great strength thus being achieved. In the second stage peroxide bleaching takes place at a lower pH value more favourable to high brightness.

There are two main implementations of this method. The one consists in that an acid, e.g. sulphuric acid, is added towards the end of a HAPB, e.g. after one hour's bleaching time, to lower the pH to a level where the remaining peroxide may be used for bleaching (for about one hour). There is then obtained a pulp which has greatly improved strength and surface properties and a brightness which is (nearly) the same, in relation to the peroxide charge, as would be obtained in a standard brightness bleaching.

The second implementation which is the one preferred, is a 2-stage bleaching, strength and surface smoothness being obtained in the first stage and desired brightness in the second stage. The second stage can take place with or without intermediate washing (i.e. only withdrawal). Bleaching in the second step heavily improves brightness for very small peroxide consumption.

It will be seen from the following tables what brightness values are obtained in normal peroxide bleaching and hyperalkaline peroxide bleaching (table 1), and what brightness values are obtained after the second bleaching stage (table 2) in a method in accordance with the invention using the second implementation of the method and the same pulps.

TABLE 1

Brightness after bleaching of groundwood (SGW) and thermomechanical pulp (TMP), respectively, to maximum brightness (standard bleaching) and to high strength, hyper-alkaline peroxide bleaching (HAPB), i.e. with an initial pH of 13. The peroxide consumption is given in parentheses.
Peroxide charge 4%, time 120 minutes and temperature 60° C.

| | Brightness according to ISO | |
|---|---|---|
| | Standard bleaching | HAPB |
| SGW | 78.7 (2.3%) | 75.1 (3.0%) |
| TMP | 78.6 (2.5%) | 74.7 (2.8%) |

TABLE 2

Brightness according to ISO after peroxide bleaching of a hyper-alkaline peroxide bleached (HAPB) pulp. Brightness after HAPB see table 1. Peroxide consumption in the second step is given in parenthesis.

| | Second stage bleaching | | |
|---|---|---|---|
| | 1% | 2% | 4% peroxide charge in 2nd stage |
| SGW | 81.9 (0.1%) | 83.3 (0.1%) | — |
| TMP | — | 80.0 (0.9%) | 81.6 (0.5%) |

After the second stage bleaching, pulps were obtained with greatly improved strength and surface properties, and with very high brightness. Note that the brightness is very much higher than what may normally be obtained in a standard bleaching (table 1). The peroxide consumptions in the second stage are very small and the optimum bleaching pH is somewhat lower than for a first stage standard bleaching.

The strength and smoothness of the pulps are not notably affected by the 2-stage bleaching, i.e. they retain the high strength and roughness which is the result of the hyper-alkaline peroxide bleaching.

As has been discussed above, the bleaching in the first stage is carried out with an initial pH of over 12, at or over 13. The peroxide charge may then be 1–8%, suitably 2–4% (on the amount of dry pulp).

The second stage is generally carried out with an initial pH which is 1–2 units lower than the initial pH in a first stage. For example, it may be in the range 10–12, preferably 11–11.5. The peroxide charge, when the second implementation of the method is used, may be 1–8%, suitably 2–4% reckoned on the dry pulp.

Both stages can be carried out at a pulp concentration of 7–35%, preferably 10–15%, suitably 11–12%, e.g. in a bleaching tower and at a temperature of 40°–95° C.

The invention is more closely clarified by the following implementation examples.

The following bleaching technique has been used in the experiment described below.

The initial pH optimum was determined first in relation to brightness for a given peroxide charge. This can be done in the following way, for example: 10 grams bone-dry pulp is slurried warm (SCAN M 10: 76) in deionized water (or the like). 0.1% DTPA, counted on the pulp, is added during slurrying. The pulp is dewatered on a wire gauze on a Büchner funnel. The filtrate is returned to the funnel and filtrated through the previously formed pulp cake for recovering the fine material which goes through during the first dewatering step. This is repeated until the filtrate is free from fine material (i.e. it is clear and often slightly coloured). The pulp is then put into a plastic bag which is sealed (plastic welded) and put into a water bath for being heated to the bleaching temperature (most often 60° C.). The bleaching chemicals, which are commercial silicate (most often 4% of the pulp) magnesium sulphate (most often 0.1% of the pulp) and alkali to the intended initial pH are mixed in a plastic jar and heated to bleaching temperature. The peroxide at room temperature is added to the chemical mixture immediately before mixing into the pulp. By "initial pH" is intended here the pH in the chemical mixture at 24° C., including the dilution water and the amount of water contained in the wet pulp, but excluding the pulp itself. The dilution water quantity is adjusted such that the pulp concentration after the chemicals are mixed in will be the correct one, most often 15%. The bag with the heated pulp is opened and the bleaching chemicals are added. The pulp is subsequently kneaded intensively so that homogenous blending is obtained. The bag is sealed and returned to the water bath. After 5 hours and 15 minutes' bleaching time the pulp is kneaded further.

Bleaching takes place in a water bath, most often at 60° C. and during 120 minutes. The bleaching time is the time from mixing in the bleaching chemicals to the time for washing with deionized water, which is at room temperature. The bag is taken out of the water bath some minutes before full bleaching time and opened, a sample then being taken out for residue chemical analysis. In order to prevent pulp coming out together with residue chemicals, the liquid is pressed out through a fine wire gauze. Final pH is measured at room temperature and residue peroxide is determined with the aid of iodine titration. The pulp is put in a Büchner funnel and washed with about 6 liters of deionized water in accordance with the method described for slushing. The washed pulp is then slushed with a minor quantity of deionized water and the suspension is titrated down to about pH 5–6. The pulp is analyzed according to applicable SCAN methods.

By repeating these bleachings with varying initial pH, the relationship between brightness and initial pH may be determined.

EXAMPLE 1

Addition of Acid

If bleaching is carried out at a higher initial pH, e.g. 13, than what is optimum with relation to brightness, so-called hyper-alkaline peroxide bleaching (HAPB), obtained a pulp which has obtained strength and smoothness increases from the bleaching but with brightness which is not optimum in relation to the peroxide charge. If an acid, e.g. sulphuric acid, is added after a HAPB to the suspension of pulp and bleaching chemical, so that the bleaching liquor pH is lowered to 12, for example, and the bleaching is allowed to continue for a further 60 minutes before termination according to the method given above, a brightness is obtained which is practically the same as with bleaching for optimum brightness. The pulp is then both strong and smooth. The results from bleaching carried out with an acid will be seen from table 3.

EXAMPLE 2

Two-stage Bleaching

Hyper-alkaline peroxide bleaching is performed first, e.g. 4% $H_2O_2$ and an initial pH of 13. A new peroxide bleaching is subsequently carried out with or without intermediate washing, and this can be done in the following manner:

(a) With washing

After hyper-alkaline peroxide bleaching with washing, bleaching is performed again, e.g. with a 4% peroxide charge, with the intention of increasing brightness. For the second bleaching step, performed with the same technique as the first, the initial pH must be optimated with relation to brightness. The optimum initial pH in the second step was 11.5, i.e. a half unit lower than what is optimum for a single stage bleaching.

(b) Without washing

The second stage can also be carried out without intermediate washing. Peroxide is then added to the pulp suspension, and possibly acid to obtain optimum pH. A small amount of the bleaching liquid may possibly be pressed out before the addition of peroxide, so that the pulp concentration will not be too low. Bleaching is then allowed to continue for a further 120 minutes, for example. A pulp is then obtained with increased strength and smoothness and with very high brightness, higher than what can be achieved in one stage optimalized for brightness.

The results from bleachings carried out thus will be seen from table 3.

TABLE 3

Tensile index, Scott Bond, roughness and brightness for unbleached and bleached groundwood and thermo-mechanical pulp, respectively, 4% peroxide charge

| | Unbleached | | Bleaching for maximum brightness | | HAPB | | HAPB + acid | | HAPB + brightness bleaching | |
|---|---|---|---|---|---|---|---|---|---|---|
| | groundw. | thermom. | groundw. | thermom. | groundw. | thermom. | groundw. | thermom. | groundw. | thermom. |
| Tensile index, kNm/kg | 25.0 | 26.0 | 33.0 | 33.0 | 42.0 | 39.5 | 42.0 | 39.5 | 42.0 | 39.5 |
| Scott Bond, J/m$^2$ | 125 | 90 | 220 | 120 | 330 | 160 | 330 | 160 | 330 | 160 |
| Roughness, Bendtsen ml/min | — | 720 | — | 400 | — | 270 | — | 270 | — | 270 |
| Brightness, ISO | 62.0 | 58.0 | 78.7 | 78.6 | 75.1 | 74.7 | — | 78.5 | 83.3 | 81.6 |
| Peroxide consumption, % | — | — | 2.3 | 2.5 | 3.0 | 2.8 | — | 3.5 | 3.1$^{xx}$ | 3.3$^{xx}$ |

*2% $H_2O_2$
**total for 2 stages

I claim:

1. A method of two-stage peroxide bleaching of mechanical or chemi-mechanical pulp to provide both high strength and brightness, said method comprising:

(a) performing in a first stage at 40°–95° C. a hyperalkaline peroxide bleaching at a initial pH of 13 or higher, as measured in the bleaching liquor at 24° C. before mixing into the pulp, thus imparting an increase in density, strength and surface smoothness to the pulp, (b) after said first bleaching stage, draining of the waste bleaching liquor, washing of the pulp with water, addition of peroxide and adjusting the pH of the pulp suspension to 1 to 2 units lower than the initial pH of the bleaching liquor in the first stage, and (c) finally bleaching the pulp in a second peroxide bleaching stage having an initial pH at the adjusted pH of step (b), thus achieving the desired brightness increase and retaining the pulp strength and surface smoothness, with a substantially lower consumption of peroxide in the second stage than in the first stage.

2. Method as claimed in claim 1, in which the initial pH of the pulp suspension in the second stage is above 10.5 and not above 11.5.

3. Method as claimed in claim 1, in which the first stage is carried out with a peroxide charge of 1–8%, based on the quantity of dry pulp, and at an initial pH of over 13.

4. Method as claimed in claim 1, in which bleaching is carried out in a bleaching tower at a pulp concentration of 7–35%.

5. Method as claimed in claim 1, in which bleaching is carried out at a temperature of 40–95° C.

6. Method as claimed in claim 1, in which the pulp is charged with silicate in an amount of 2–6%, based on the amount of dry pulp.

7. Method as claimed in claim 1, in which the second stage is carried out with a peroxide charge of 1–8%, based on the quantity of dry pulp.

* * * * *